US007721518B2

(12) United States Patent
Danzey

(10) Patent No.: US 7,721,518 B2
(45) Date of Patent: May 25, 2010

(54) YARNS FOR CUT-RESISTANT WEBBING AND OTHER PRODUCTS

(75) Inventor: Lee B. Danzey, Mashpee, MA (US)

(73) Assignee: Pascale Industries, Inc., Pine Bluff, AR (US)

( * ) Notice: Subject to any disclaimer, the term of this patent is extended or adjusted under 35 U.S.C. 154(b) by 588 days.

(21) Appl. No.: 11/698,044

(22) Filed: Jan. 26, 2007

(65) Prior Publication Data

US 2008/0182471 A1 Jul. 31, 2008

(51) Int. Cl.
*D02G 3/02* (2006.01)

(52) U.S. Cl. ..... 57/210; 57/230

(58) Field of Classification Search ..... 57/210, 57/230

See application file for complete search history.

(56) References Cited

U.S. PATENT DOCUMENTS

| | | | |
|---|---|---|---|
| 2,169,930 | A | 8/1939 | Schuster |
| 2,258,508 | A | 10/1941 | Kerchner |
| 2,659,958 | A | 11/1953 | Johnson |
| 3,117,371 | A | 1/1964 | Farley |
| 3,526,565 | A | 9/1970 | Walter |
| 3,571,814 | A | 3/1971 | Miller |
| 3,629,053 | A | 12/1971 | Kimura et al. |
| 3,632,383 | A | 1/1972 | Dominick et al. |
| 3,729,920 | A | 5/1973 | Sayers et al. |
| 3,756,004 | A | 9/1973 | Gore |
| 3,762,982 | A | 10/1973 | Whittington |
| 3,894,742 | A | 7/1975 | Trelease |
| 4,052,095 | A | 10/1977 | Johnson |
| 4,282,398 | A | 8/1981 | Solomon |
| 4,312,260 | A | 1/1982 | Morieras |
| 4,381,639 | A | 5/1983 | Kress |
| 4,501,782 | A | 2/1985 | Weatherly et al. |
| 4,522,203 | A | 6/1985 | Mays |
| 4,600,626 | A | 7/1986 | Ogata |
| 4,640,179 | A | 2/1987 | Cameron |
| 4,779,869 | A | 10/1988 | Spann |
| 4,793,130 | A | 12/1988 | Togashi et al. |
| 4,856,837 | A | 8/1989 | Hammersla, Jr. |
| 4,929,478 | A | 5/1990 | Conaghan et al. |
| 4,987,030 | A | 1/1991 | Saito et al. |
| 5,014,755 | A | 5/1991 | Bompard et al. |
| 5,087,327 | A | 2/1992 | Hood |
| 5,167,263 | A | 12/1992 | Kelen et al. |

(Continued)

*Primary Examiner*—Shaun R Hurley
(74) *Attorney, Agent, or Firm*—Michael de Angeli

(57) ABSTRACT

Improved yarns the properties of which can be altered by heat treatment for various products are disclosed, as well as product made therewith and processes thereof. The yarns of the invention comprise a multifilamentary core of a comparatively lower melting point material, such as polypropylene or polyethylene, which is wrapped in both S and Z directions (that is, both clockwise and counterclockwise) by multifilamentary strands of a higher melting point material, such as polyester. For providing cut and abrasion resistance to webbing and products made therefrom, such as cargo lifting slings and the like, on the order of 8-12 such yarns are woven into the edges of webbing material, such that they contact one another. Upon heat treatment, the material of the multifilamentary core melts to the extent that it wicks into and "wets out" the material of the multifilamentary wrappers; upon cooling, the filaments of the wrapper are disposed in a solidified matrix of the core material, forming a comparatively hard, tough material, and the adjacent yarns are bonded to one another to some degree.

28 Claims, 3 Drawing Sheets

U.S. PATENT DOCUMENTS

| | | | | |
|---|---|---|---|---|
| 5,219,636 | A | 6/1993 | Golz | |
| 5,414,984 | A * | 5/1995 | Groshens et al. | 57/234 |
| 5,419,951 | A | 5/1995 | Golz | |
| 5,582,212 | A | 12/1996 | Tanzosh | |
| 5,845,476 | A | 12/1998 | Kolmes | |
| 6,050,077 | A | 4/2000 | Muller | |
| 6,532,724 | B2 | 3/2003 | Patrick | |
| 6,635,825 | B2 | 10/2003 | Adachi | |
| 6,658,835 | B1 * | 12/2003 | Bowers | 57/210 |
| 7,398,640 | B2 * | 7/2008 | Bowers | 57/210 |
| 2003/0074879 | A1 | 4/2003 | Patrick | |
| 2004/0265581 | A1 * | 12/2004 | Esnault et al. | 428/364 |
| 2005/0022494 | A1 | 2/2005 | Piat | |
| 2007/0178790 | A1 * | 8/2007 | Gardner et al. | 442/190 |

* cited by examiner

YARNS FOR CUT-RESISTANT WEBBING AND OTHER PRODUCTS

FIELD OF THE INVENTION

This invention relates to an improved yarn intended to be woven into products such as webbing as used to make cargo lifting slings and the like; the yarn of the invention can be used in particular to provide cut and abrasion resistance to the edges of the webbing. The invention also includes the webbing, the process of making the webbing, products made from the webbing, and other products made using the yarn of the invention.

BACKGROUND OF THE INVENTION

Woven fabric webbing is used to make a wide variety of products, including cargo lifting slings, safety harnesses of various types, and the like. In applications where abrasion resistance is particularly required, such as for cargo lifting slings, it is known to weave yarns of cut- and abrasion-resistant material into the edges of the flat woven webbing to protect it in use.

For example, Kelen et al U.S. Pat. No. 5,167,263 shows weaving a polyamid yarn or monofilament into the edges of webbing for similar purposes. Hammersla U.S. Pat. No. 4,856,837 shows a yarn made up of strands comprising a core, e.g., a polyester cord, covered by a continuous sheath of a cut-resistant resin such as "Hytrel" thermoplastic polyester elastomer. A number of such yarns are woven into the opposed edges of the flat webbing and used without performance of any treatment intended to alter the properties of either the core or the sheath.

Golz U.S. Pat. Nos. 5,219,636 and 5,419,951 show a yarn for similar use comprising a number of filaments, each filament in turn comprising a monofilamentary core of a first material, typically polyester, covered by a continuous, solid sheath of a second material; the material of the sheath is to have a lower melting point than the material of the core. Exemplary sheath materials are nylon-6, polypropylene, or polyethylene. After these yarns are woven into the webbing, the assembly is heat treated to a temperature such that the material of the sheath melts, whereupon the sheaths of the several filaments adhere to one another, forming a solid mass with the core members embedded therein upon cooling.

While webbing made according to the teachings of both the Hammersla and Golz patents has been commercially successful, further improvement is always to be sought.

SUMMARY OF THE INVENTION

The present invention relates to improved yarns useful for various purposes, including providing cut- and abrasion-resistance to webbing, to products such as webbing made using these yarns, and to products made therefrom, such as cargo lifting slings and the like. The yarns of the invention comprise a multifilamentary core of a comparatively lower melting point material, such as polypropylene or polyethylene, which is wrapped in both S and Z directions (that is, both clockwise and counterclockwise) by multifilamentary strands of a higher melting point material, such as polyester. Several, on the order of 8-12, of such yarns are woven into the opposed edges of webbing, such that the yarns contact one another and form the outermost edges of the webbing. Upon heat treatment, the material of the multifilamentary core melts, wicking into and "wetting out" the material of the multifilamentary wrappers to a degree; upon cooling, the filaments of the wrapper are disposed in a matrix of the core material, forming a comparatively hard, tough material, and the adjacent yarns are bonded to one another to some degree. Improved cut and abrasion resistance with respect to the Hammersla and Golz yarns have been observed. The heat treatment step can conveniently be carried out while drying the webbing following a dyeing operation, which also serves to contract the yarns of the webbing and compact the weave.

As noted, the invention also includes products other than webbing made using the yarns as above, to products made of the webbing, and to the process of making these products.

BRIEF DESCRIPTION OF THE DRAWINGS

The invention will be more readily understood if reference is made to the accompanying drawings, wherein.

DESCRIPTION OF THE PREFERRED EMBODIMENT

Figure 1:
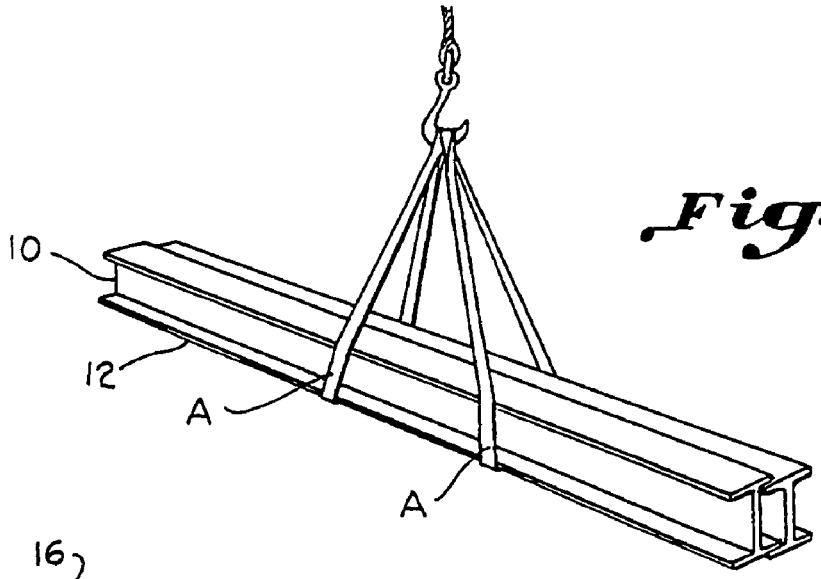
FIG. 1 is a perspective view illustrating use of a typical cargo sling constructed of webbing made in accordance with the present invention.

FIG. 1 illustrates a typical sling application in which a pair of cargo webbing slings A constructed in accordance with the present invention are used to hoist two I-beams 10 having flanges 12. Flanges 12 tend to be sharp-edged and can cut into the edges of typical slings, offering a severe application.

Figure 2:
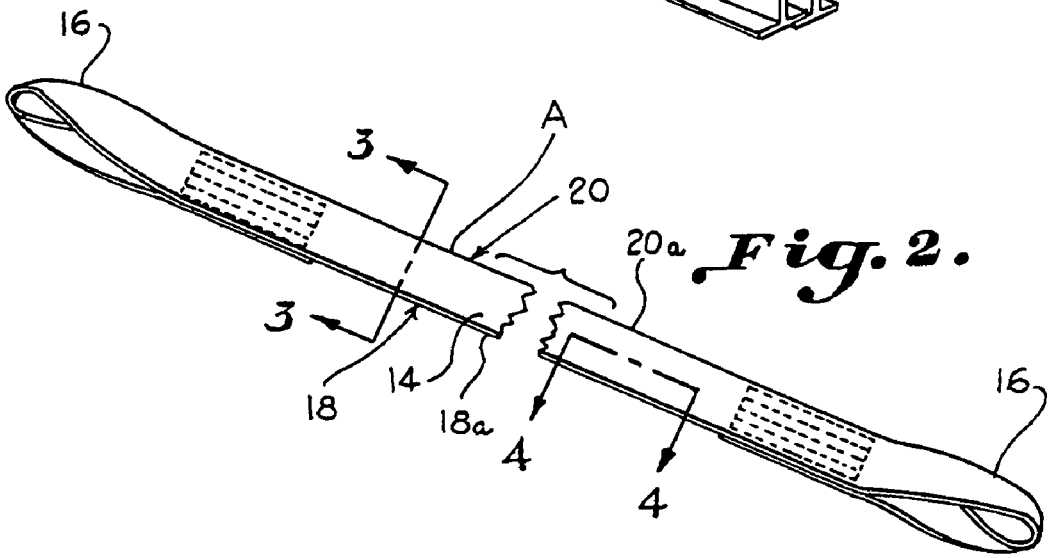
FIG. 2 is a perspective view of a reinforced cargo sling constructed in accordance with the present invention.

FIG. 2 illustrates a cargo sling A, which is made from woven webbing 14 with a twisted soft eye 16 at each end of the webbing formed by stitching the webbing back on itself. In accordance with the invention, the opposing edges 18 and 20 of the webbing are reinforced continuously along its length by reinforcing structures 18*a* and 20*a* respectively. Reinforcing structures 18*a* and 20*a* are formed by weaving yarns according to the invention into the webbing, followed by heat treatment.

Figure 3:
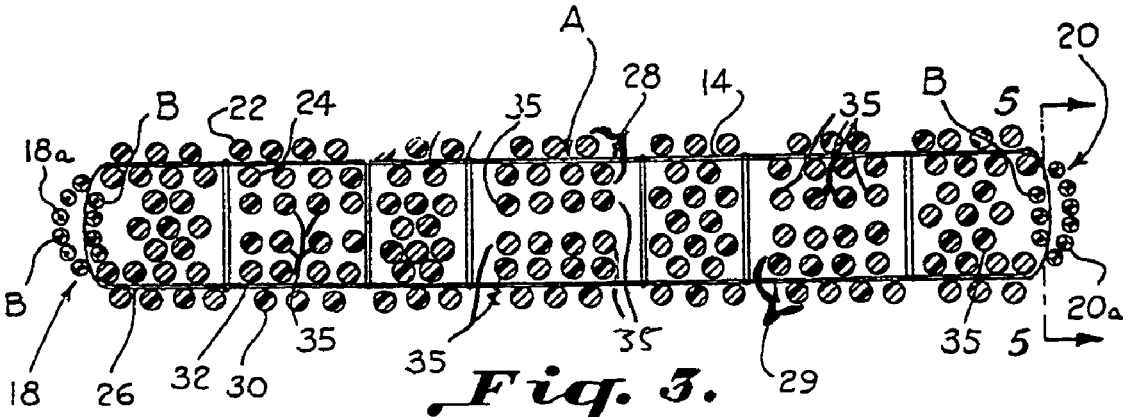
FIG. 3 is a sectional view taken along line 3-3 of FIG. 2.
Figure 4:
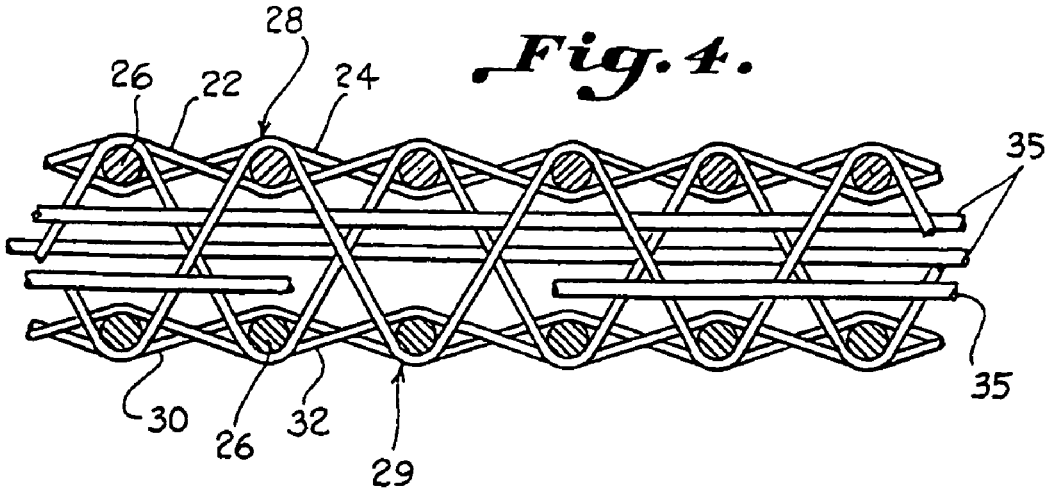
FIG. 4 is a sectional view taken along line 4-4 of FIG. 2.
Figure 5:
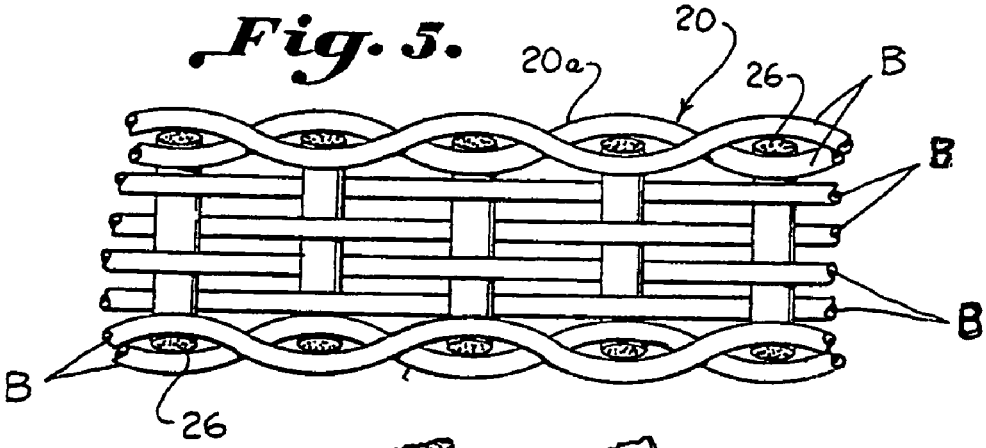
FIG. 5 is an enlarged view of one edge of a reinforced cargo sling constructed in accordance with the present invention, taken along the line 5-5 of FIG. 3, prior to heat treatment.

As illustrated in FIGS. 3-5, yarns B according to the invention are woven entirely about and along the edges 18 and 20 of the webbing. As discussed in further detail below, the yarns according to the invention comprise a multifilamentary core of a lower melting point polymer material, such as polyethylene or polypropylene, wrapped by strands of multifilamentary polymer material of higher melting point, such as polyester. After weaving, the webbing is heat-treated under conditions such that while the filaments of the wrappers do not melt, the core material melts to a degree such that as it cools and hardens, it tends to form a solid mass that is much superior in terms of cut and abrasion resistance than had been the multifilamentary yarn prior to heat treatment. Furthermore, the molten core material tends to wick into and "wet out" the filaments of the wrappers (that is, capillary action causes the molten core material to flow around the strands of the multifilamentary wrapper) to some extent, so that when the molten core material solidifies upon cooling the filaments of the wrappers are captured in a matrix of the core material. Further, the molten core material of adjacent yarns becomes intermingled to a degree as the material melts, so that upon cooling the adjacent strands are adhered to one another.

In other respects, webbing 14 is conventional and can be made by various techniques well known in the art. The basic structure of the webbing can be as shown by the Hammersla patent, whereby the webbing 14 may be woven in a plain weave pattern with adjacent warp yarns 22 and 24 woven alternately up and down 180 degrees out of phase with a weft yarn 26 in a first outer ply 28. A second outer ply 29 of woven webbing 14 is woven in a similar manner with a second warp system of adjacently woven warp yarns 30 and 32 woven 180 degrees out of phase with weft yarn 26. Warp binders C are woven between the outer plies 28, 29 in an undulating pattern, 180 degrees out of phase. Plies of additional material 35 may extend in the warp direction between outer plies 28, 29 so as to be bound by the plies 28, 29 and warp binders C woven between the plies. Other methods of making webbing and similar products are well known to the art and are within the scope of the invention.

Figure 9:
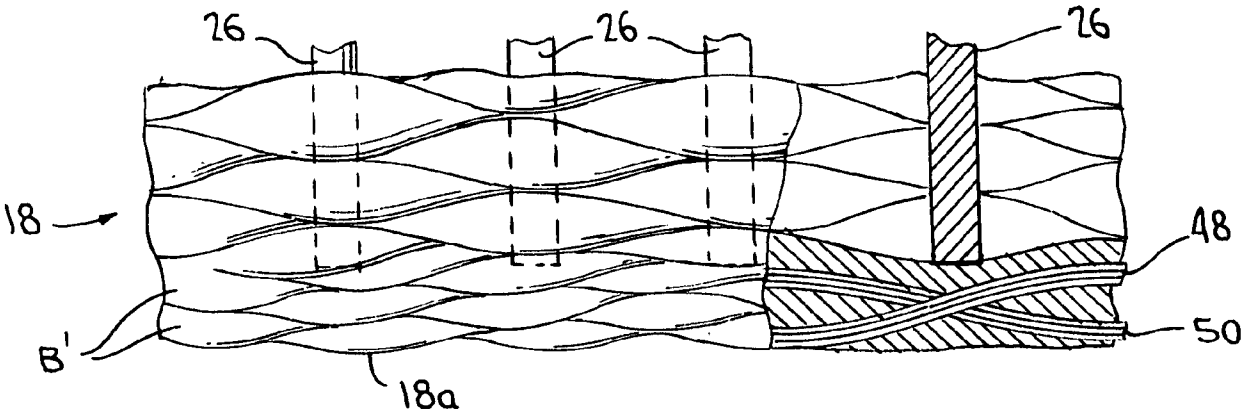
FIG. 9 is a plan view, partially in cross-section, of one edge of the webbing including the yarns of the invention, having been heat treated.

Referring now in more detail to reinforcing structures 18*a* and 20*a*, as can best be seen in FIGS. 3 and 5, and again as in Hammersla, the protective yarns B according to the invention are also woven in a plain weave pattern at edges 18 and 20 of the webbing 14 in an undulating pattern 180 degrees out of phase. As illustrated in FIG. 3, yarns B are woven into the webbing so that they begin at a point on first outer ply 29 and continue around, for example, edge 18 of webbing 14 to an opposing point on second outer ply 28. After heat treatment, and as shown in FIG. 9, yarns B form a reinforcing structure 18*a* substantially covering the outer edge of sling A at edge 18, while reinforcing structure 20*a* similarly covers a like portion of the opposed edge 20 of sling A.

Figure 6:
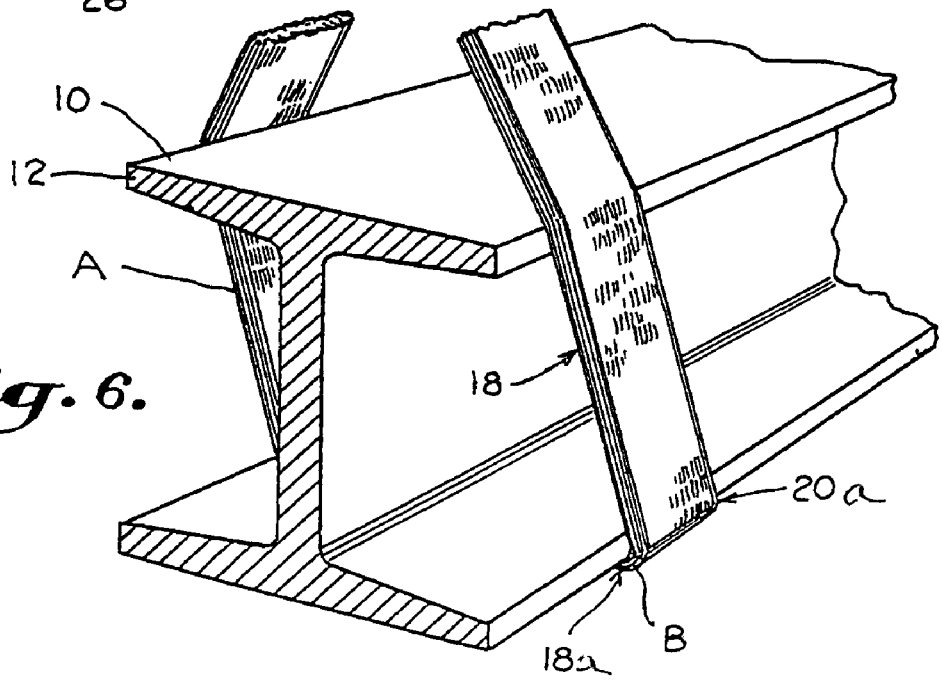
FIG. 6 is an enlarged perspective view of an I-beam held by a reinforced webbing sling according to the invention.

As can best be seen in FIG. 6, the edges 18 and 20 of the webbing are protected by reinforcing structures 18*a* and 20*a* respectively, so that the sharp edges of flange 12 of I-beam 10 are prevented from directly contacting the regular warp yarns 22, 24 or 30, 32.

Figure 7:
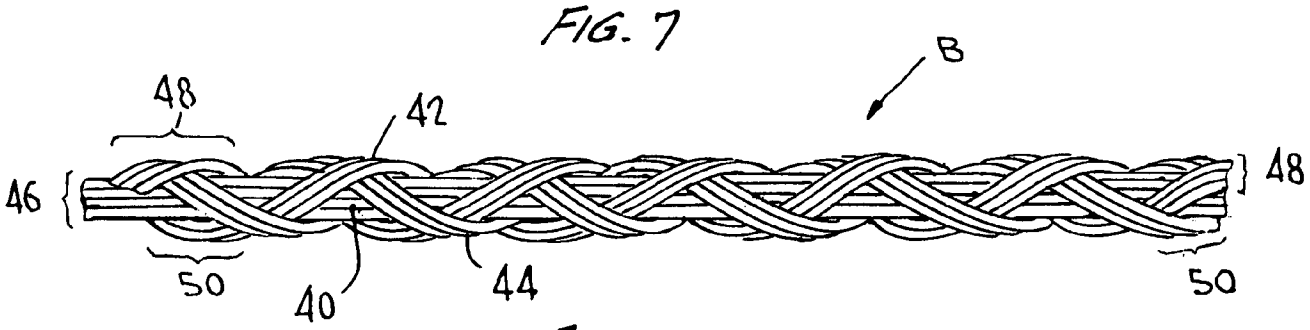
FIG. 7 is a side view of a yarn according to the invention for reinforcing and providing cut and abrasion resistance to the edges of webbing according to the invention, prior to heat treatment.

FIG. 7 shows an elevational view of a short length of the yarn B according to the invention. As discussed briefly above, the yarn B of the invention comprises a multifilamentary core 40, that is, comprising many filaments 46 of material of lower melting point, wrapped by at least one and preferably two multifilamentary strands 42 and 44, that is, each also comprising many filaments 48 and 50, of material of higher melting point.

In one successfully tested embodiment, core 40 comprised three "ends" (that is, three identical, separately prepared multifilamentary members) of 600 denier, 200 filament polypropylene material, such that the core 40 comprised 600 total filaments 46 totaling 1800 denier. (The fact that the core was made up of three identical ends was simply a matter of processing convenience; the core could equivalently have been prepared as a single multifilamentary member or from a different number of ends as desired.) Both polypropylene, which melts at 320-330° F., and polyethylene, which melts at 230-260° F., have been successfully tested as core materials. This core was wrapped by multifilamentary strands 42 and 44, one of each being applied in both the S- and Z-directions, that is, one clockwise and the other counterclockwise, each comprising 1000 denier polyester, which melts at about 490° F. Each strand 42, 44 comprised 96 filaments 48 and 50 respectively. The rate of wrapping of the strands 42 and 44 was such that the surface of the core 40 was 57% covered.

Figure 8:
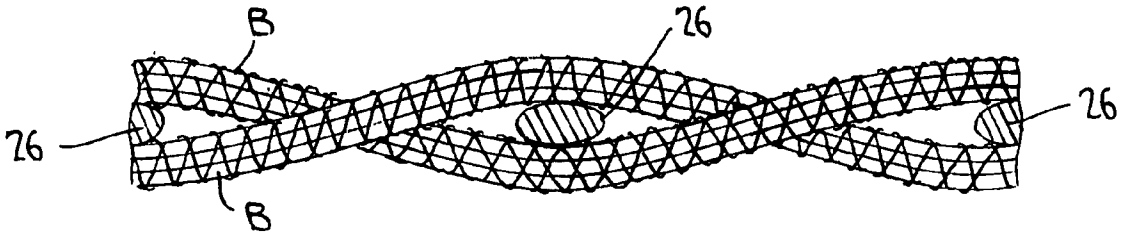
FIG. 8 is a cross-sectional view through a webbing including the yarns of the invention, prior to heat treatment.

FIG. 8 shows a sectional view taken longitudinally through a simplified version of webbing A according to the invention, depicted prior to heat treatment, illustrating that the yarns B according to the invention are woven conventionally alternatingly above and below the weft yarns 26.

FIG. 9 shows a plan view of one edge 18 of the webbing A after heat treatment. As illustrated, the multifilamentary material of the cores 40 of the yarns B has been at least partially melted responsive to heat treatment and then consolidated after cooling, such that the several yarns B' are effectively bonded to one another, forming a protective edge 18*a* on the webbing A; the filaments 48, 50 of wrapped strands 42 and 44 have not melted and remain continuous, as illustrated where the consolidated core material is shown cut away in the drawing.

As indicated, several, typically on the order of 8-12, of such yarns B will be woven into both the opposed edges of webbing, that is, at the same time the bulk of the webbing is being woven out of other materials, followed by heat treatment to cause the yarns B to form the desired edge-protective structure. More or fewer yarns could alternatively be employed without departure from the invention, of course. Indeed, it is within the scope of the invention to weave the entire webbing of the yarns of the invention, or to employ the yarn of the invention for part or all of the warp and/or weft yarns.

Conveniently, the heat treatment that is performed to cause the yarns of the invention to form the edge-protective structure can be provided at the same time the webbing is heated for another purpose. For example, at least one manufacturer of webbing for slings and the like dyes the webbing and then heat treats it, to drive off moisture from the dyeing process and to shrink the yarns of the webbing. The heat treatment is carried out by running the continuous webbing exiting the dyeing vat back-and-forth over a succession of rollers disposed in an oven, so that a desired residence time is achieved, with some tension applied. The overall effect is to simultaneously dry the webbing and compact the weave. It is desired that this heat treatment also be employed to cause the yarns of the invention to form the desired opposed protective edges on the webbing. Accordingly, the characteristics of the yarns of the invention should be selected such that the same heat treatment as desired for the drying and compacting process causes the material of the cores of the yarns of the invention to melt sufficiently such that the desired results are obtained.

More specifically, the heat treatment is to be performed such that the material of the core 40 is melted to the extent that it wicks into and "wets out" the multifilamentary wrappers 42 and 44 to some extent, and so that the core material of adjacent yarns B intermingle to some degree, so that comparatively solid protective and reinforcing structures 18*a* and 20*a* are formed on opposed edges 18 and 20 of the webbing upon subsequent cooling and solidification. Good results were obtained when yarns comprising three ends of 600-denier, 200-filament polypropylene core material (totaling 600 filaments and 1800 denier, as above) wrapped by two 96-filament, 1000-denier strands of polyester, as described above, were woven into webbing and heat treated as part of a drying step, as also described above, such that the webbing exiting the dye bath in a continuous process was run over a sequence of rollers in an oven at 410°-415° F. such that the total residence time was on the order of six minutes.

It is within the skill of the art to perform experimentation as needed to establish the optimal heat treatment conditions with respect to a given yarn construction; for example, it was found in testing that slightly heavier polypropylene filaments, which comprised 144 filaments for a 600 denier "end", required somewhat more time to melt than did the 200-filament material described above. Likewise, of course, lab test results with respect to tests carried out on dry samples will differ somewhat from results from production conditions where the heat treatment also includes a drying step.

In the following, the cut resistance of webbing made using the yarns of the invention is compared to otherwise similar products employing the yarns described in the Hammersla patent. As above, Hammersla teaches reinforcing the edges of webbing using yarns comprising a multifilamentary polyester cord in a continuous nylon sheath. While the samples of webbing using the Hammersla yarns employed for the tests described below were subsequently dyed and dried by heat-treatment, as described above, and so as to compact the weave, the heat treatment is not intended and does not appear to alter the properties of the edge-protecting yarns.

The test procedure may be summarized as follows. Webbing samples are stretched between fixed clamps. A specified blade is suspended on a weighted pivoted arm, arranged such that when the blade is drawn back a specified distance and released, gravity causes it to impact the edge of the webbing. The blade cuts the webbing to a depth which is then measured and used as a direct indicator of the cut resistance of the webbing.

For a given cut test, all else being equal, webbing without any edge protection is cut to a depth in a range from an arbitrary value X to about 125% X. For webbing woven according to the Hammersla patent, using the yarns described therein, and heat treated as above, the cut depth is between 50% and 85% X. For webbing similarly woven as in the Hammersla patent, and heat treated as above, differing only in that the edges are protected using the yarns of the invention, the cut depth is only 2-4% X. Commercial webbing understood by the applicant to be made according to the Golz patent typically exhibits cut resistance comparable to that made according to the Hammersla teachings. These results, while obviously not entirely definitive, do indicate that a substantial improvement is provided according to the present invention.

As noted above, a degree of experimentation will be required to optimize the various parameters involved with implementing the invention, such as the number of filaments and denier of the multifilamentary materials used for the core and wrapped strands of the yarns of the invention, the selection of the materials themselves, the number of yarns to be incorporated into a particular webbing design and the weaving pattern to be employed, and the temperature and duration of the heat treatment to be performed. Such experimentation is considered to be within the skill of the art.

Typical core specifications for yarns to be used for protecting the edges of webbing used for cargo slings and the like might include 1000-2500 denier of the lower melting point material, with the filaments sized such that 200-1000 total filaments are provided, of polypropylene or polyethylene. Each yarn would then comprise such a core wrapped in at least one but preferably two 500-1500 denier strands of higher melting point material; typically each strand might comprise between 75 and 250 filaments of polyester material. Heat treatment conditions might be from 250-450° F. for between two and fifteen minutes; obviously the choice of the lower melting point material, and the fineness of the filaments, substantially affects the heat treatment desired.

Finer yarns according to the invention might be used for lighter-weight webbing, both to protect its edges, as above, or as some or all of the longitudinal warp fibers, and/or the transverse weft fibers. Such webbing might be useful as durable, strong, cut and abrasion-resistant but inexpensive material for seat belts, safety harnesses, apparel components, and the like. For example, a yarn suitable for protecting the edge of a seatbelt otherwise woven of polyester yarns might comprise a 500 denier core of polypropylene or polyethylene wrapped by two 150 denier strands of polyester. Alternatively, the entire webbing might be woven of the yarn of the invention, or the yarn of the invention could be used in specified regions where additional strength or stiffness were desired.

In each case, the degree to which the wrapped strands cover the core of the yarn can vary widely, e.g., between 20 and 100%.

It will be appreciated that the term "melts" as used herein and in the appended claims is intended to refer to softening and at most partial liquefaction of the core material. The core material is not, of course, to be melted to the point of dripping off the woven webbing, but only to the degree necessary to achieve the goals of the invention, that is, in order to capture the wrapped multifilamentary strands in a solid matrix after resolidification, and so that the adjacent yarns are at least partially adhered to one another.

Given that the inner core material is intended to melt during heat treatment and then resolidify, it might seem logical that the multifilamentary core material specified could be replaced with a monofilamentary core. However, in the sizes considered appropriate, monofilamentary material would be difficult to weave, and would require much more heating to melt than a comparable quantity of multifilamentary material. It might also be more difficult to control the degree of melting of a monofilamentary material. Hence multifilamentary material is preferred for the core; wrapping the core with strands of the higher melting point material keeps the multifilamentary core stable during processing, e.g., weaving. The wrapped strands can also provide mechanical strength to the eventual composite reinforcing structures formed upon heat treatment.

Finally, while polyethylene or polypropylene have been mentioned throughout as exemplary material for the lower-melting point material of the core of the yarn of the invention, the invention of course is not so limited; other possible materials for the filaments of the core could include ethylene vinyl acetate as used in hot melt applications, polyamide, nylon, low-melting point polyester, and variants and mixtures of these. Likewise, while higher melting point polyester has been mentioned as the preferred material for the filaments of the strands, nylon and other comparable materials might also be employed within the scope of the invention.

The fact that the properties of the yarn of the invention can be altered by performance of a simple heat treatment after weaving can be exploited to yield desired properties for the final product while providing significant processing convenience. This attribute of the yarns of the invention can be expected to provide wide applicability. Stated differently, the yarns of the invention can be conveniently woven or otherwise initially integrated into a precursor of a product prior to heat treatment, because they are comparatively soft and flexible. After heat treatment, as above, they become relatively hard and stiff, as well as cut- and abrasion-resistant, because after resolidification the multifilamentary material of the core forms an integrated structure. That is, to a degree the core forms a matrix within which the material of the strands is confined.

For example, as in the example discussed in detail above, where the yarns of the invention are used to impart cut- and abrasion-resistance to the edges of webbing, the yarns, as they adjoin one another, will be effectively adhered to one another upon heat treatment, forming an integrated structure in which the filaments of the strands are confined in the resolidified material of the cores of the yarns. Alternatively, the yarns of the invention can be incorporated individually into a product precursor, such that the heat treatment will alter the properties of the final product in a desired manner. For example, if the yarns of the invention are employed as transverse yarns in webbing, the heat treatment will transversely stiffen the webbing, causing it to tend to lie flat, which will be useful in a variety of products. Accordingly, the invention should not be limited to the specific products discussed herein.

Therefore, the above specification of the yarns of the invention, the webbing and other items woven therefrom, the end products made thereof, and the processing steps described are not to be taken as limiting of the invention, but only as exemplary thereof. The invention is to be limited only by the following claims.

What is claimed is:

1. A product manufactured employing yarns, said yarns each comprising:

a multifilamentary core consisting of a first lower melting point polymeric material; and at least one strand consisting of multifilamentary higher melting point polymeric material wrapped around said core, said yarns having been heat treated after initial incorporation of said yarn into a precursor of said product to cause the material of said core to melt such that after subsequent solidification the material of the core forms a matrix in which the filaments of the strand are confined.

2. The product of claim 1, wherein two strands of multifilamentary higher melting point polymeric material are wrapped in opposite directions around said core.

3. The product of claim 1, wherein said multifilamentary higher melting point polymeric material includes at least one of polyester and nylon materials.

4. The product of claim 1, wherein said multifilamentary lower melting point polymeric material includes at least one of polyethylene, polypropylene, ethylene vinyl acetate, polyamide, nylon, and polyester.

5. The product of claim 1, wherein said core comprises on the order of 200-2000 total filaments of the lower melting point core material, with the total core weight between 500 and 2500 denier.

6. The product of claim 1, wherein said at least one strand of multifilamentary higher melting point polymeric material wrapped around said core weighs between 150 and 1500 denier.

7. The product of claim 1, wherein the product comprises a webbing comprising a plurality of the yarns of woven at least into the edges of the webbing, said webbing being heat treated after weaving such that the core material of said yarns melts and solidifies into a solid mass upon cooling and the material of the cores of adjoining yarns adheres to one another.

8. A product made of the webbing of claim 7.

9. A sling made of the webbing of claim 7.

10. A method for making a product comprising a yarn, comprising the steps of:

providing a multifilamentary core of a first lower melting point polymeric material;

wrapping said core in at least one strand of multifilamentary higher melting point polymeric material, to form a yarn;

employing said yarn to form a product precursor; and heat treating said product precursor such that the multifilamentary cores of the yarns melt and solidify upon subsequent cooling so as to form an integrated structure.

11. The method of claim 10, wherein two strands of multifilamentary higher melting point polymeric material are wrapped in opposite directions around said core.

12. The method of claim 10, wherein said multifilamentary higher melting point polymeric material is at least one of polyester and nylon.

13. The method of claim 10, wherein said multifilamentary lower melting point polymeric material includes at least one of polyethylene, polypropylene, ethylene vinyl acetate, polyamide, nylon, and polyester.

14. The method of claim 10, wherein said core comprises on the order of 200-2000 total filaments of the lower melting point core material, with the total core weight between 500 and 2500 denier.

15. The method of claim 10, wherein each of said at least one strand(s) of multifilamentary higher melting point polymeric material wrapped around said core weighs between 150 and 1500 denier.

16. The method of claim 10, wherein said product is a webbing, and said yarns are woven into at least the opposed edges of said webbing, whereby a cut- and abrasion-resistant structure is formed along the edges of the webbing upon cooling following performance of said heat treatment.

17. The method of claim 16, wherein said webbing is dyed after being woven and said heat treatment step is performed as part of drying said webbing after dyeing.

18. The method of claim 16, wherein between 8 and 12 of said yarns are woven into either edge of the webbing.

19. The method of claim 10, wherein said heat treatment is carried out by exposing said precursor product to a temperature of between 250 and 450° F. for between two and fifteen minutes.

20. A method for making a webbing having reinforced edges, comprising the steps of:

providing a multifilamentary core of a first lower melting point polymeric material;

wrapping said core in at least one strand of multifilamentary higher melting point polymeric material, to form a yarn;

weaving a plurality of said yarns into the edges of a webbing; and heat treating said webbing having had said yarns woven thereinto such that the multifilamentary cores of the yarns melt and solidify upon cooling so as to form a cut- and abrasion-resistant structure along the edges of said webbing.

21. The method of claim 20, wherein two strands of multifilamentary higher melting point polymeric material are wrapped in opposite directions around said core.

22. The method of claim 20, wherein said multifilamentary higher melting point polymeric material is polyester.

23. The method of claim 20, wherein said multifilamentary lower melting point polymeric material is selected from the group comprising polyethylene and polypropylene.

24. The method of claim 20, wherein said core comprises on the order of 200-2000 total filaments of the lower melting point core material, with the total core weight between 1000 and 2500 denier.

25. The method of claim 20, wherein each of said at least one strand(s) of multifilamentary higher melting point polymeric material wrapped around said core weighs between 500 and 1500 denier.

26. The method of claim 20, wherein said webbing is dyed after being woven and said heat treatment step is performed as part of drying said webbing after dyeing.

27. The method of claim 20, wherein between 8 and 12 of said yarns are woven into opposed edges of the webbing.

28. The method of claim 20, wherein said heat treatment is carried out by exposing said webbing to a temperature of between 250 and 450° F. for between two and fifteen minutes.

* * * * *